US005094400A

United States Patent [19]

Ching

[11] Patent Number: 5,094,400

[45] Date of Patent: Mar. 10, 1992

[54] SPRAYING APPARATUS

[76] Inventor: Fu H. Ching, 3 Fl., No. 72, Ta Hsin St., Taichung, Taiwan

[21] Appl. No.: 642,832

[22] Filed: Jan. 18, 1991

[51] Int. Cl.[5] ..... B05B 7/30

[52] U.S. Cl. ..... 239/341; 239/353; 239/415

[58] Field of Search ..... 239/341, 345, 346, 353, 239/375, 415

[56] References Cited

U.S. PATENT DOCUMENTS

| | | | |
|---|---|---|---|
| 595,931 | 12/1897 | Wold | 239/353 X |
| 1,272,752 | 7/1918 | Wold | 239/353 X |
| 1,703,359 | 2/1929 | Paasche | 239/353 |
| 1,751,608 | 3/1930 | Tittemore et al. | 239/415 |
| 3,122,324 | 2/1964 | Lee | 239/415 X |
| 4,102,500 | 7/1978 | Luff | 239/345 |
| 4,161,289 | 7/1979 | Rebold | 239/353 X |
| 4,941,614 | 7/1990 | Ilott | 239/346 X |

*Primary Examiner*—Andres Kashnikow
*Assistant Examiner*—William Grant
*Attorney, Agent, or Firm*—Staas & Halsey

[57] ABSTRACT

A spraying device includes a cap and two barrels coupled to form a structure. Compressed air can be supplied from the rear end of the structure. A cup for containing paint materials is coupled to the front end of the structure. A nozzle is disposed in the cap for controlling a passage of the paint materials. A valve device is actuated by a knob to open an air passage of the structure. When the knob is pushed rearward, the valve device is opened so that the compressed air may flow out of the cap, and when the knob is further pushed rearward, the nozzle can be opened so that the paint materials can be sucked to flow out of the cap when the compressed air flows out of the cap.

7 Claims, 5 Drawing Sheets

SPRAYING APPARATUS

FIELD OF THE INVENTION

The present invention relates to a spraying apparatus, and more particularly to a spraying apparatus which can be easily operated.

BACKGROUND OF THE INVENTION

Various kinds of spraying devices have been developed, in which two examples are disclosed in U.S. Pat. No. 1,268,403 to Stacker; and U.S. Pat. No. 1,299,290 to Berg. These spraying devices have a hollow sleeve and the like coupled to a compressor which supplies air to the spraying devices, in which the hollow sleeves are coupled to the middle portion of the spraying devices and are perpendicular to the spraying devices so that the air hoses coupled between the compressor and the spraying devices may interfere the operation of the spraying devices. In addition, the trigger for controlling the operation thereof is also perpendicular to the body of the spraying devices. The operation is also interfered.

Another type of spraying device is disclosed in U.S. Pat. No. 3,113,725 to Packard et al. The spraying device has a gun body. This device is provided for spraying a chemical intermixed with water. The user should hold the handle lever 46 and the handle 30 together so that the device can be operated. Therefore, the device can not be fine tuned.

The present invention has arisen to mitigate and/or obviate the afore-described disadvantages of the conventional spraying devices.

SUMMARY OF THE INVENTION

The primary objective of the present invention is to provide a spraying apparatus which can be easily operated and can be fine tuned.

In accordance with one aspect of the invention, there is provided a spraying apparatus which includes a cap and two barrels coupled together to form a unitary structure, a compressed air is supplied from a rear end of the structure. A needle is provided in the structure. A cup for containing paint materials is coupled to the front portion of the structure and is communicated with the interior of the structure. A nozzle is disposed in the cap for controlling a passage of the paint materials, the nozzle can be opened when the needle moves rearward and can be blocked when the needle moves forward. A knob is received in the middle portion of the structure and is longitudinally slidable. A valve device is disposed in the middle of the structure and is actuated by the knob to close and to open an air passage within the structure. A retaining device is provided in the rear portion of the structure for holding a rear end of the needle so that the retaining device and the needle move in concert. The retaining device is actuated to move by the valve device and is pushed rearward after the valve device is opened. When the knob is pushed rearward, the valve device is opened by the knob so that the compressed air may flow through the valve device and may flow out of the cap, and when the knob is further pushed rearward, the retaining device is caused to move rearward by the valve device so that the needle can be caused to move rearward and so that the nozzle can be opened. The paint materials can be sucked to flow through the nozzle and can flow out of the cap when the compressed air flows out of the cap. The flow rate of the compressed air can be fine tuned by the knob.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
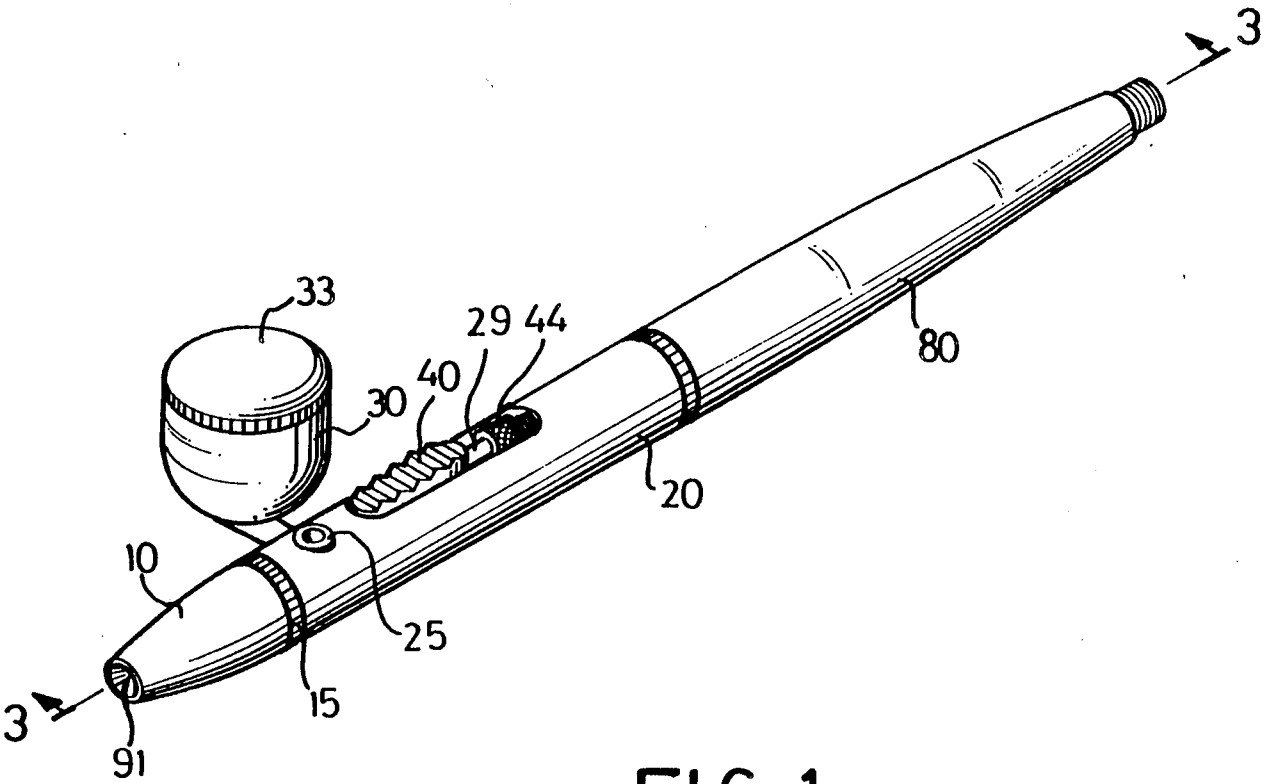
FIG. 1 is a perspective viw of a spraying device in accordance with the present invention.

Referring to the drawings and initially to FIG. 1, a spraying device in accordance with the present invention comprises generally a cap 10 and two barrels 20, 80 coupled together to form a unitary structure, and a cup 30 coupled to the barrel 20 for containing paint materials.

Figure 2:
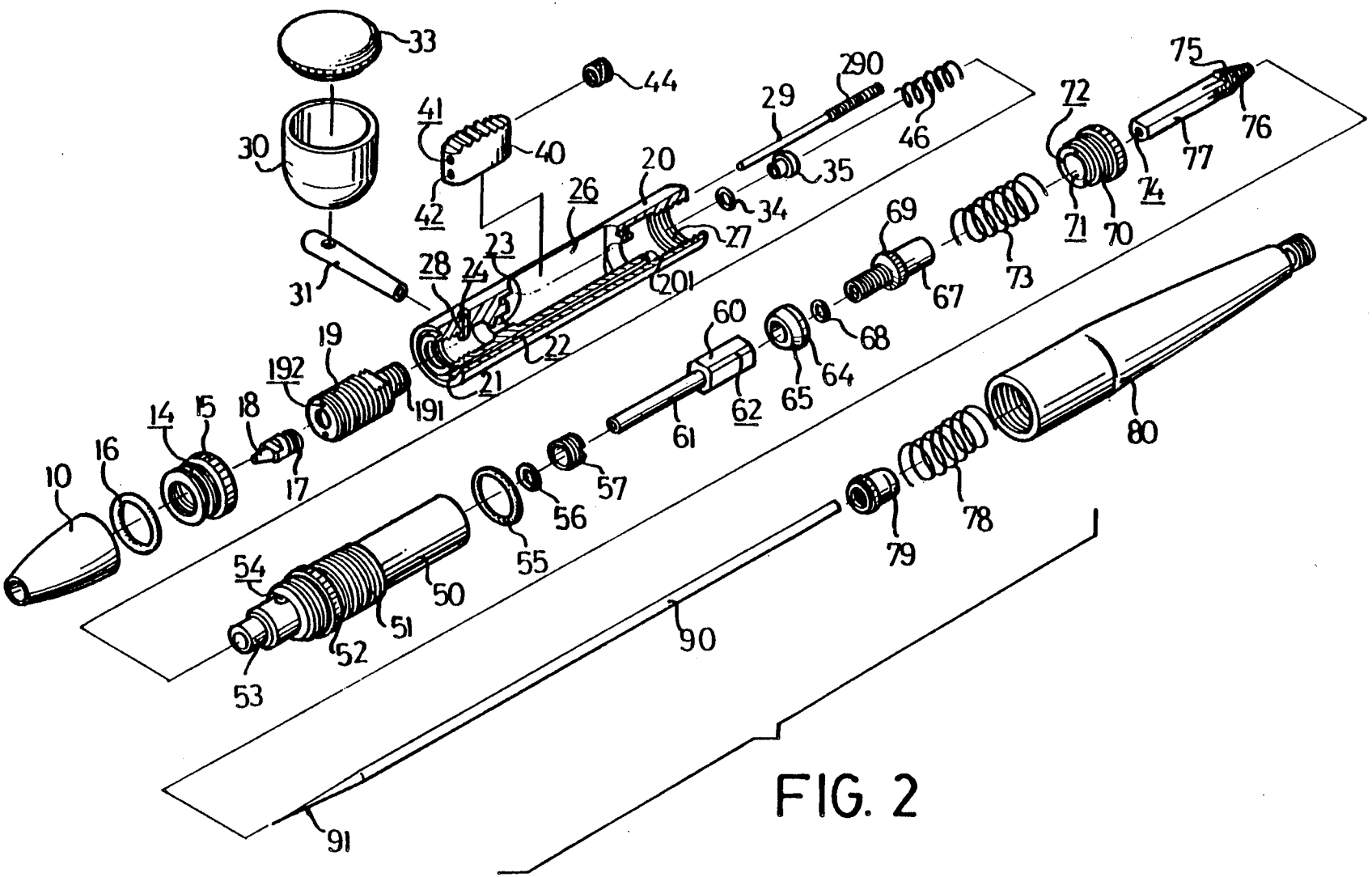
FIG. 2 is an exploded view of the spraying device.
Figure 3:
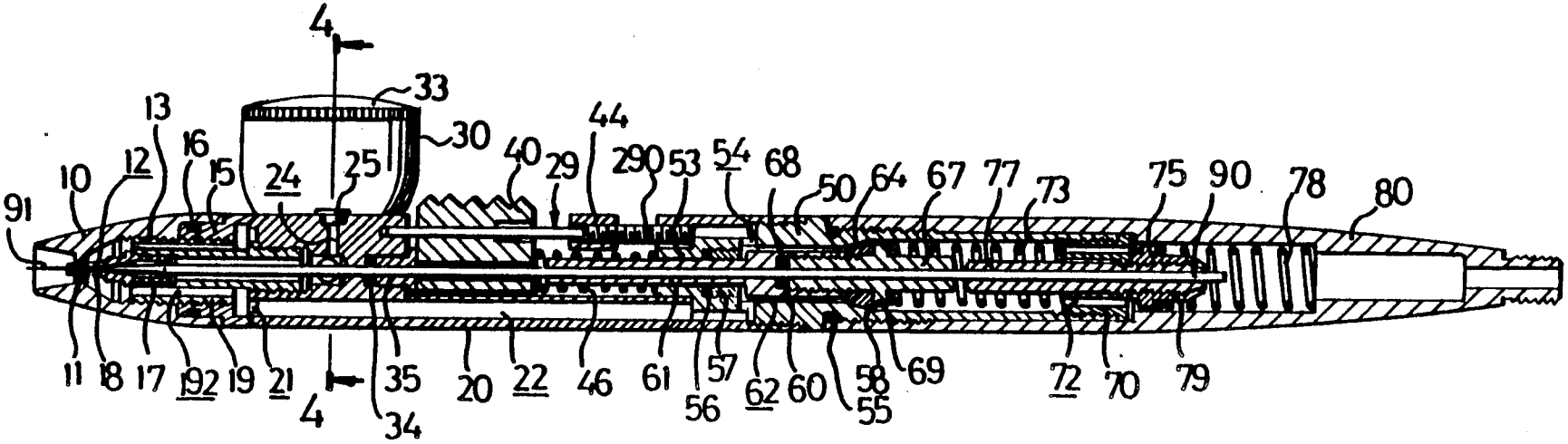
FIG. 3 is a longitudinal cross sectional view taken along lines 3—3 of FIG. 1.
Figure 4:
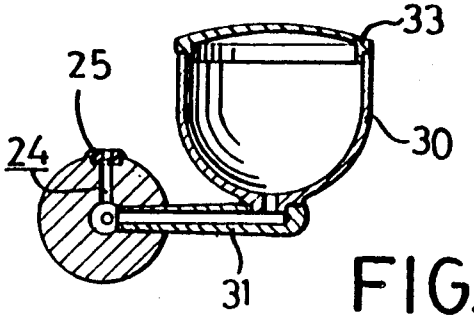
FIG. 4 is a cross sectional view taken along lines 4—4 of FIG. 3.

Referring next to FIGS. 2, 3 and 4, an annular flange 11 with a hole 12 formed therein is formed in the front and inner portion of the cap 10. An inner thread 13 is formed in the middle portion of the cap 10. An annular groove 14 is formed in a sleeve 15 for receiving a sealing ring 16 which makes an air tight seal between the sleeve 15 and the cap 10. A rear end of a nozzle 17 is threaded into a front end of a bolt 19 which has a reduced diameter rear end 191 threaded into a front end of the barrel 20. The nozzle 17 has a tapered front end 18 which is received within the hole 12 of the cap 10 and which is arranged such that a gap is formed therebetween in order to provide an air passage. Two apertures 192 are formed through the length of the bolt 19. The front end of the bolt 19 is threaded through the sleeve 15 and is threadedly engaged with the inner thread 13 of the cap 10. A front end portion of a needle 90 extends through the barrel 20 and the bolt 19, and the needle 90 has a tapered front end 91 extended through the front end 18 of the nozzle 17.

An annular recess 21 is formed in the front end of the barrel 20 and is communicated with a through hole 22 which is substantially formed through the barrel 20. A center hole 23 is formed in the middle portion of the barrel 20 for receiving a sealing ring 34 and a plug 35 which are provided around the needle 90. An air hole 24 is vertically formed in the front portion of the barrel 20 and a plug 25 is force-fitted to enclose the upper end of the air hole 24. An opening 26 is formed in the upper and middle portion of the barrel 20. An inner thread 27 is formed in the rear end of the barrel 20. A hole 28 is formed in the upper end portion of the barrel for receiving a tube 31 which has an open inner end and a closed outer end. A rod 29 which has a thread 290 formed on one end thereof is threadedly supported in the upper portion of the opening 26. The cup 30 is threaded to the outer end portion of the tube 31 for containing paint material. A lid 33 is provided for enclosing the cup 30. The cup 30 is communicated with the front end of the barrel 20 by the tube 31. An annular shoulder 201 is formed in the rear portion of the barrel 20.

A knob 40 has two holes 41, 42 longitudinally formed therein for receiving the rod 29 and the needle 90 respectively so that the knob 40 is guided to move forward and rearward within the opening 26 by the rod 29 and the needle 90. A control ferrule 44 is threaded on the thread 290 of the rod 29 so that the rod 29 can be caused to move longitudinally by a rotation of the control ferrule 44. A pipe 50 has an outer thread 51 formed on the middle portion thereof for threadedly engaged with the inner thread 27 of the barrel 20. An annular flange 52 is formed on the middle portion of the outer thread 51, and a sealing ring 55 is disposed beside the annular flange 52. The front end of the pipe 50 has a reduced diameter so that a shoulder is formed. The shoulder is engaged with the annular shoulder 201 of the barrel 20 so that the relative movement between the barrel 20 and the pipe 50 is limited. A hole 54 is formed in front of the outer thread 51 so that the interior of the pipe 50 is communicated with the outer peripheral surface of the front portion of the pipe 50 which is communicated with the through hole 22 of the barrel 20. A tapered surface 58 (FIG. 3) is formed in the middle portion of the pipe 50.

A sleeve 57 is threaded in the inner and front end of the pipe 50 and a sealing ring 56 is provided in front of the sleeve 57. A stem 60 has an extension 61 formed in the front end thereof which is slidably extended through the sleeve 57 and the front end 53 of the pipe 50. A spring 46 is provided on the extension 61 and is biased between the knob 40 and the front end 53 of the pipe 50. Each corner area 62 of the stem 60 is cut off. A front end of a connector 67 is threaded into the rear end of the stem 60 and a sealing ring 68 is disposed in front of the connector 67. A ring 64 is disposed between the stem 60 and an annular flange 69 of the connector 67, and a tapered surface 65 is formed in front of the ring 64 for engagement with the tapered surface 58 of the pipe 50. A cork or plug 70 which has a hole 71 formed therein is threaded to the rear end of the pipe 50. Three holes 72 are formed through the cork 70. A spring 73 is biased between the annular flange 69 of the connector 67 and the cork 70 so that the ring 64 is biased forward to contact the tapered surface 58 of the pipe 50.

A bar 77 has a hole formed therein for receiving the rear end of the needle 90. Four blades 75 are formed on the rear end of the bar 77 which is tapered and which has an outer thread 76 formed thereon. The needle 90 is clamped by the blades 75 of the bar 77 when a sleeve nut 79 is threadedly engaged to the rear end of the bar 77 so that the needle 90 and the bar 77 move in concert. The sleeve nut 79 is biased forward by a spring 78. It is to be noted that the rear ends of the holes 72 of the cork 70 are not blocked or closed by the sleeve nut 79. The rear end of the barrel 80 is coupled to a pneumatic system (not shown) which supplies compressed air.

In operation, initially, as shown in FIG. 3, the holes 72 of the cork 70 form an air passage so that compressed air can flow through the holes 72 into the pipe 50. The ring 64 is biased forward by the spring 73 to engage with the tapered surface 58 of the pipe 50 so that an air passage is also closed. The knob 40 is biased forward by the spring 46. The needle 90 is caused to move forward so that the tapered front end 91 of the needle 90 closes the nozzle 17.

Figure 5:
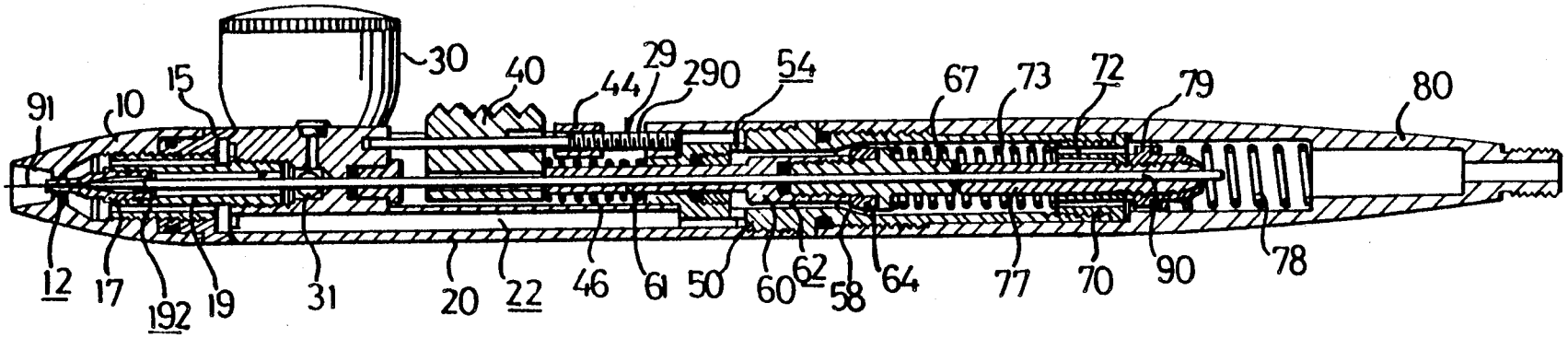
FIGS. 5 and 6 are cross sectional views similar to FIG. 3, illustrating the operation of the device.

Referring next to FIG. 5, when the knob 40 is pushed rearward by a user, the knob 40 will push the extension 61 of the stem 60 rearward so that the ring 64 is separated from the tapered surface 58 of the pipe 50 and so that an air passage is formed. Compressed air may flow through the passage formed between the ring 64 and the tapered inner surface 58 of the pipe 50, and flow through the cut off corner areas 62 of the stem 60, the hole 54 of the pipe 50, the through hole 22 of the barrel 20, the apertures 192 of the bolt 19, and the hole 12 of the cap 10 so that the compressed air can flow out from the front end of the cap 10. At this moment, the connector 67 does not contact the bar 77 yet so that the needle 90 is not moved and so that the nozzle 17 is still blocked by the tapered front end of the needle 90.

Figure 6:
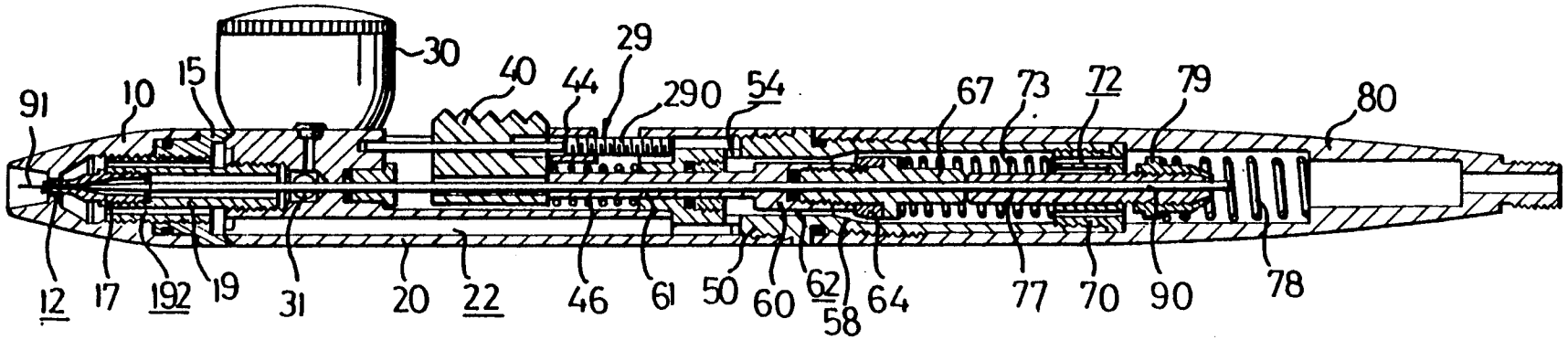

Referring next to FIG. 6, when the knob 40 is further pushed rearward, the bar 77 is pushed rearward by the connector 67 so that the needle 90 is also pushed rearward, the nozzle 17 is then opened and is not blocked by the tapered front end of the needle 90 any more so that paint materials contained within the cup 30 can flow through the tube 31 and the bolt 19 and can flow out from the front end 18 of the nozzle 17. When compressed air flows out of the cap 10, the paint materials will be sucked by the compressed air to flow out of the cap 10. The gap between the sleeve nut 79 and the cork 70 can be controlled by the knob 40 which is controlled by the user so that the flow rate of the compressed air can be controlled by the user and so that the spraying apparatus can be fine tuned.

Figure 7:
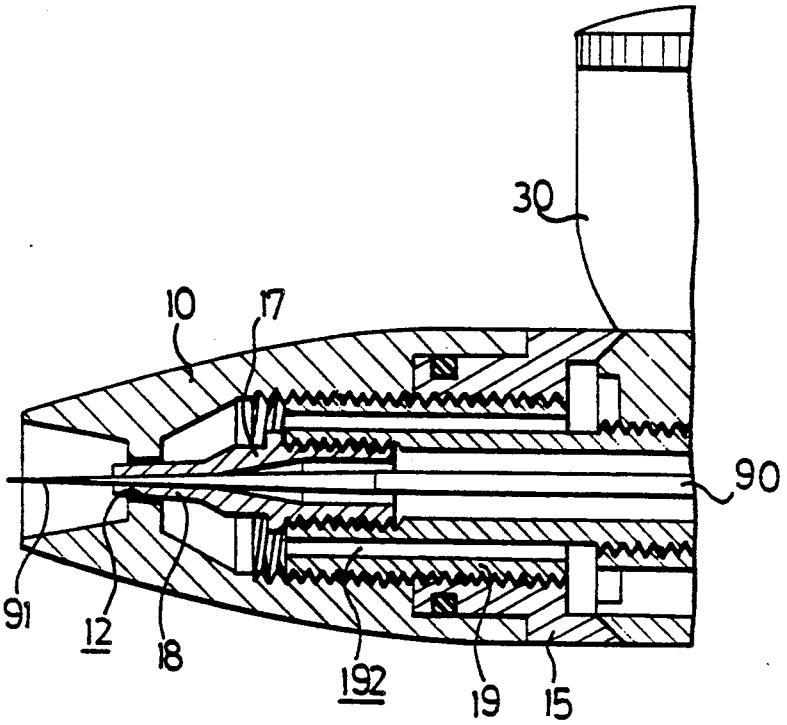
FIGS. 7 and 8 are enlarged cross sectional views of the front portions of the device.
Figure 8:
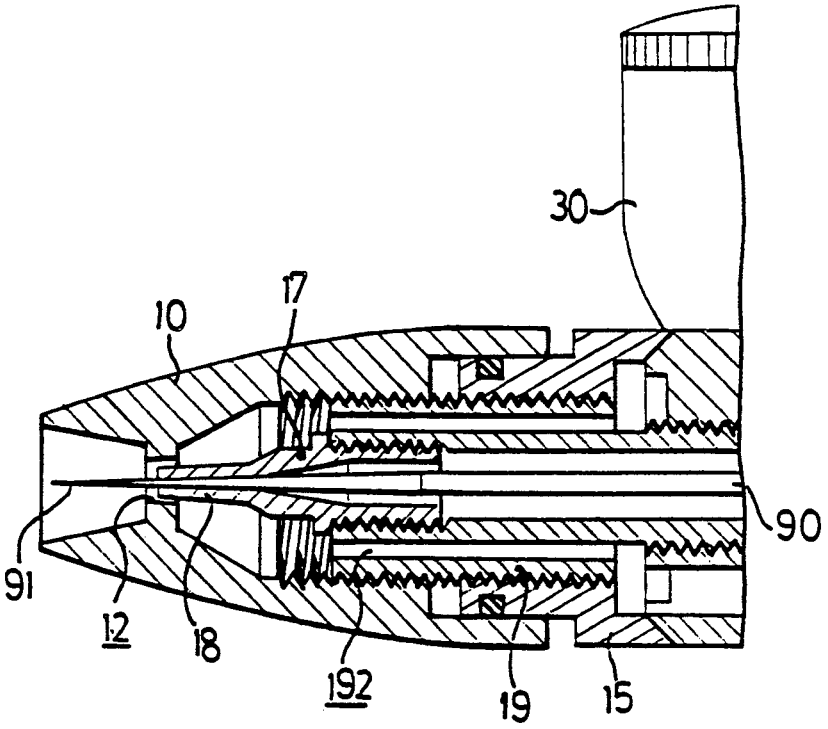

As shown in FIGS. 7 and 8, when the cap 10 is rotated relative to the bolt 19, the cap 10 may be moved forward so that the hole 12 can be gradually opened and so that much more compressed air can flow through the hole 12 in order that the suction force for the paint materials can be adjusted.

Accordingly, the spraying apparatus in accordance with the present invention can be easily operated by simply pushing the knob 40 rearward and the spraying apparatus can be fine tuned.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spraying apparatus comprising:

a cap, a first barrel and a second barrel coupled together to form a unitary structure, said first barrel being coupled between said cap and said second barrel, compressed air being supplied from a rear end of said second barrel into said unitary structure;

a needle being longitudinally provided in said unitary structure;

a cup which is provided for containing paint materials being coupled to a front end of said first barrel and being communicated with an interior of said front end of said first barrel by a tube;

a nozzle being coupled to a front end of a bolt which is threaded into said cap from a rear end thereof, an interior of said bolt being communicated with said interior of said front end of said first barrel so that said paint materials contained within said cup may flow through said bolt and said nozzle and may flow out of said cap, a front end of said needle being tapered and being extended through said nozzle, said nozzle being opened when said needle moves rearward relative to said nozzle and can be blocked when said needle moves forward, a first hole being formed in said bolt;

a knob being received in an upper and middle portion of said first barrel and being longitudinally slidable;

a valve means being disposed in said first barrel and being actuated by said knob to close and to open an air passage within said first barrel;

a retaining means being provided in said second barrel for holding a rear end of said needle so that said retaining means and said needle move in concert, said retaining means being actuated to move forward and rearward in said second barrel by said valve means, said retaining means being pushed rearward after said valve means is opened;

when said knob is pushed rearward, said valve means is opened by a rearward movement of said knob so that said compressed air may flow through said valve means and said first hole of said bolt and may flow out of said cap; and when said knob is further pushed rearward, said retaining means being caused to move rearward by a rearward movement of said valve means so that said needle can be caused to move rearward and so that said nozzle can be opened, said paint materials can be sucked to flow through said bolt and said nozzle and can flow out of said cap when said compressed air flows out of said cap, a flow rate of said compressed air can be controlled by the rearward movement of said knob so that said spraying apparatus can be fine tuned.

2. A spraying apparatus according to claim 1, wherein a sleeve is threaded on a middle portion of said bolt and is located in said rear end of said cap, a first sealing ring is disposed between said cap and said sleeve for making a fluid tight seal therebetween; a first plug and a second sealing ring are disposed in a second hole which is formed in a middle portion of said first barrel and which is located in front of said knob, said second sealing ring is disposed around said needle for making a fluid tight seal between said needle and said a middle portion of said first barrel.

3. A spraying apparatus according to claim 1, wherein said knob has two third holes longitudinally formed therein, a rod extends through one of said third holes and is threadedly supported in said upper and middle portion of said first barrel, said needle extends through another of said third holes, said knob is guided to move forward and rearward by said rod and said needle.

4. A spraying apparatus according to claim 3, wherein an outer thread is formed on one end portion of said rod, a control ferrule is threaded on said outer thread of said rod so that said rod can be actuated to move forward and rearward by a rotation of said control ferrule.

5. A spraying apparatus according to claim 3, wherein a fourth hole is substantially formed through said first barrel and is communicated with said first hole of said bolt, a pipe is coupled between said first barrel and said second barrel, said air passage is formed in said pipe, a fifth hole is formed in a front end of said pipe so that an interior of said pipe is communicated with said fourth hole of said first barrel, said valve means is disposed in said pipe and comprises a stem extended in a front end of said pipe, said stem has an extension extending beyond said front end of said pipe, said extension can be actuated to move rearward by said knob, a front end of a connector is threaded into a rear end of said stem, a ring is disposed on said connector, a tapered surface is formed in a middle portion of said pipe, a first spring is provided to bias said connector and said ring forward so that said ring is engageable with said tapered surface of said pipe in order to close said air passage of said pipe, and said ring can be separated from said tapered surface when said extension of said stem is pushed rearward by said knob so that said compressed air may flow through between said tapered surface and said ring.

6. A spraying apparatus according to claim 5, wherein said retaining device comprises a plug threaded into a rear end of said pipe, at least one sixth hole is formed through said plug for communicating an interior of said pipe with said rear end of said second barrel, said first spring is biased between said rear end of said connector and said plug so that said connector can be biased forward, a bar extends through said plug, four blades are formed on a rear end of said bar and an outer thread is formed on said blades, a sleeve nut is threadedly engaged on said blades, said rear end of said needle is clamped by said blades when said sleeve nut is threadedly engaged on said blades, a second spring is biased between a rear end of said sleeve nut and said second barrel in order to bias said bar and said needle forward, said bar is pushed rearward by said connector after said ring is separated from said tapered surface, and said nozzle is opened when said bar and said needle are pushed rearward so that said compressed air can flow out of said cap before said paint materials.

7. A spraying apparatus according to claim 1, wherein an annular flange is formed in a front portion of said cap, a front end of said nozzle extends through said annular flange and a gap is formed between said front end of said nozzle and said annular flange so that said compressed air may flow therethrough, and when said cap is threaded relative to said bolt, an open size of said gap can be varied so that said flow rate of said compressed air can be adjusted.

* * * * *